United States Patent [19]

Tamura et al.

[11] Patent Number: 4,649,094

[45] Date of Patent: Mar. 10, 1987

[54] IMAGE FORMATION METHOD AND APPARATUS IN WHICH IMAGING LIGHT AND CONDUCTIVE TONER ARE APPLIED TO OPPOSITE SURFACES OF A PHOTOSENSITIVE MEMBER

[75] Inventors: Yasuyuki Tamura, Kawasaki; Shuzo Kaneko; Tohru Takahashi, both of Tokyo, all of Japan

[73] Assignee: Canon Kabushiki Kaisha, Tokyo, Japan

[21] Appl. No.: 445,070

[22] Filed: Nov. 29, 1982

[30] Foreign Application Priority Data

Dec. 8, 1981 [JP] Japan ..... 56-197410
Dec. 8, 1981 [JP] Japan ..... 56-197412
Dec. 8, 1981 [JP] Japan ..... 56-197413

[51] Int. Cl.[4] ..... G03G 13/24
[52] U.S. Cl. ..... 430/126; 118/657
[58] Field of Search ..... 118/657, 658; 355/16, 355/3 BE, 3 R; 430/122, 126

[56] References Cited

U.S. PATENT DOCUMENTS 3,263,557 8/1968 Cunningham et al. ..... 346/160
3,561,863 2/1971 Brewster ..... 355/3 R
3,563,734 2/1971 Shely ..... 430/126
3,816,117 6/1974 Kaukeinen ..... 430/67
3,816,840 4/1973 Kotz ..... 430/122
3,890,040 6/1975 Schmidlin ..... 355/16
3,909,258 9/1975 Kotz ..... 430/122
4,298,669 11/1981 Marushima et al. ..... 430/55
4,311,776 1/1982 Seino et al. ..... 430/55
4,385,823 5/1983 Kasper et al. ..... 430/107
4,396,927 8/1983 Amaya et al. ..... 118/657

FOREIGN PATENT DOCUMENTS 1262888 2/1969 United Kingdom .

*Primary Examiner*—John L. Goodrow
*Attorney, Agent, or Firm*—Fitzpatrick, Cella Harper & Scinto

[57] ABSTRACT

This specification discloses an image formation method which uses a photosensitive member having a photoconductive layer provided on a transparent conductive layer and in which magnetic conductive particles are held and conveyed by magnetic force producing means and supplied to the photosensitive member and light information such as light signal or light image is applied to the conductive substrate side of the photosensitive member and simultaneously with the supply of the particles, the surface of the photosensitive member is developed by the particles correspondingly to the light signal or the light image, and an apparatus for realizing such method.

20 Claims, 11 Drawing Figures

IMAGE FORMATION METHOD AND APPARATUS IN WHICH IMAGING LIGHT AND CONDUCTIVE TONER ARE APPLIED TO OPPOSITE SURFACES OF A PHOTOSENSITIVE MEMBER

BACKGROUND OF THE INVENTION

1. Field of the Invention

This invention relates to an image formation method and apparatus, and more particularly to an image formation method in which light information such as light signal or light image is applied to a photosensitive member and an image corresponding to the light information is formed on the photosensitive member by conductive particles, and an apparatus to which such method is applied.

2. Description of the Prior Art

As a method for forming a toner image on the light portion of a photosensitive member, a method comprising uniformly pre-charging the photosensitive member, and then applying an image light to the photosensitive member to thereby form an electrostatic latent image thereon, thereafter causing toner particles to adhere to the photosensitive member by a developing device correspondingly to the pattern of the electrostatic latent image, thereby obtaining a visible image has been widely used (this will hereinafter be referred to as the first method). In this case, it is usual to employ insulative particles as the toner particles and use them by pre-charging them to the same polarity as the polarity of the latent image on the photosensitive member due to the friction between the insulative particles and carrier particles or the like.

It is known that it is also effective to apply to the developing device a DC bias voltage of the same polarity as the polarity of the latent image on the photosensitive member at this time. Also, in Japanese Laid-open Patent Application No. 4532/1974 (corresponding U.S. Pat. No. 3,909,258), it is disclosed to effect the development by using conductive and magnetic particles as the toner.

Where the first method is used to form a toner image on the light portion of the image light on the photosensitive member, a DC bias voltage of substantially the same value as the potential of the toner carrier of the developing device and the dark portion of the image light on the photosensitive member is applied to the developing device so that in the portion corresponding to the dark portion, no potential difference is created between the developing device and the photosensitive member but only in the portion corresponding to the light portion, a potential difference is created between the photosensitive member and the toner carrier of the developing device, whereby toner is caused to adhere to the portion corresponding to the light portion.

However, where the first method is used, the steps of uniformly charging the photosensitive member by a corona charger or the like, applying the image light, and causing the toner to adhere by the developing device must be effected in succession, and an apparatus for realizing this becomes not only bulky and complex but also often defective and inferior in reliability. In particular, the charging means for uniformly charging the photosensitive member requires a high voltage source having an output of several kilovolts and is not only bulky and expensive but also involves the danger of electric shock. It is also susceptible to the influence of humidity, powder, etc. and inferior in reliability.

On the other hand, what is called the smoke printing method is known as a method which does not use the step of charging the photosensitive member and in which the step of applying the image light and the step of developing are carried out at a time (this will hereinafter be referred to as the second method). This method comprises using a photosensitive member having a photoconductive layer provided on a transparent and conductive substrate, placing a metal net-like electrode in opposed relation with the photoconductive layer, applying a light image through the transparent and conductive substrate and simultaneously therewith, blowing toner from the metal net-like electrode side, and causing the toner to be adsorbed onto a support member such as paper provided in advance in intimate contact with the photoconductive layer. As the photoconductive layer, use is made of CdS which is an N type semiconductor and in this case, a minus voltage is applied to the net-like electrode side.

This second method can obtain an image by a very simple process, but it suffers from much fog produced in the background of the image and with this method, it is difficult to obtain toner images of high image density and thus, this method has not yet been put into practical use.

Japanese Patent Publication No. 48821/1973 (corresponding U.S. Pat. No. 3,563,734 and DEOS No. 1,797,187) discloses that a conductive pattern formed on a photosensitive member is developed by a developer having conductivity and magnetism to thereby form an image (this will hereinafter be referred to as the third method). In this method, development is effected while applying a DC voltage between a conductive substrate on the back of the conductive pattern formed by applying a light image to the photosensitive member and the toner carrier of the developing device. An insulative layer is provided between the conductive substrate and the photoconductor.

The formation of the conductive pattern may be effected prior to or simultaneously with the development.

In the third method, where toner is caused to adhere correspondingly to the dark portion of the image light (where a positive image is to be obtained), if the photoconductor is an N type semiconductor, a negative voltage is applied to the substrate of the photoconductor and, if the photoconductor is a P type semiconductor, a positive voltage is applied to the substrate of the photoconductor. Where toner is caused to adhere correspondingly to the light portion of the image light (where a negative image is to be obtained), if the photoconductor is an N type semiconductor, a positive voltage is applied to the substrate of the photoconductor and, if the photoconductor is a P type semiconductor, a negative voltage is applied to the substrate of the photoconductor. In this case, the applied voltage is of the order of 500 V and should not be a mere DC voltage but must be a pulsating DC electric field.

If the third method is employed, a negative image can be obtained without using charging means, but where this negative image is to be obtained, an exposure amount of two to three times is necessary as compared with the case where a positive image is to be obtained, and an exposure amount of ten times or more is required as compared with the case where, as is usually done, the photosensitive member is charged and image exposure is provided to thereby form an electrostatic latent image. In the example disclosed in the aforementioned Japanese Patent Publication No. 43821/1973, use is made of an exposure amount of about 400 lux seconds and this is about 20 to 200 times the exposure amount required in the presently commonly used electrophotographic copying apparatuses. Accordingly, it is difficult to speed up the development and usually, a time of two to three seconds is required for the formation of a negative image. Also, the source of the applied voltage must be a pulsating DC power source as previously mentioned and this makes it difficult to employ a flashlight, a laser light modulated by image electrical signals, etc. as the source of image light. This is because, where exposure is effected by a source of light such as the flashlight or the modulated laser light which provides an exposure during a very short time, the image density fluctuates and a stripe pattern is created in the image depending on whether the voltage of said pulsating DC power source is in its high condition or in its low condition at the moment of exposure.

As described above, the image formation methods of the prior art have their own merits and demerits, and a method which can form a negative image for a relatively small exposure amount and at a high speed without using a complicated step such as the charging step and can form an image by scanning and exposing by the use of a modulated laser light has not yet been known.

In recent years, it has been widely practised to scan a photosensitive member by a laser light or the like modulated by image electrical signals and provide exposure to thereby obtain an image, and in this case, it is known that a more beautiful image can be obtained if the portion corresponding to the black of the image is exposed to form an image.

Also, a semiconductor laser is often used as the laser, but the light emitted by a semiconductor laser usually is near-infrared light which is low in sensitivity to a photoconductor, and the energy obtained therefrom is of the order of 10 mW at best. An image formation method effective for these usages has not yet been realized although it has been strongly desired.

SUMMARY OF THE INVENTION

It is an object of the present invention to solve the above-noted problems peculiar to the prior art and to provide a method and apparatus for forming images of high quality by a simple construction.

It is another object of the present invention to enable images of high quality to be formed even for a relatively small exposure amount without charging a photosensitive member to a high potential.

It is still another object of the present invention to enable images of high quality to be formed even at a high speed.

To achieve these objects, the present invention uses a photosensitive member having a photoconductive layer on a transparent conductive substrate. Light information such as light signal or light image is applied to the conductive substrate side of the photosensitive member and at this time, magnetic conductive particles are held and conveyed from the opposite side of the photosensitive member by magnetic force producing means and supplied into contact with the photosensitive member. As a result, an image by the particles is formed on the surface of the photosensitive member correspondingly to said light signal or the like.

The photosensitive member used with the present invention may be one having a photosensitive layer having an N type characteristic or a P type characteristic or both and a conductive substrate, or one further having an insulating layer on the surface, or one in which the photosensitive layer comprises a plurality of layers. The magnetic conductive particles may be electrophotographic toner used in the field of the conventional electrophotography and finally fixed onto a transfer medium or the like, but need not always be such electrophotographic toner when the photosensitive member is applied to a display apparatus and toner is repetitively used without being transferred to the transfer medium or the like.

The invention will become more fully apparent from the following detailed description thereof taken in conjunction with the accompanying drawings.

DESCRIPTION OF THE PREFERRED EMBODIMENT

Figure 1:
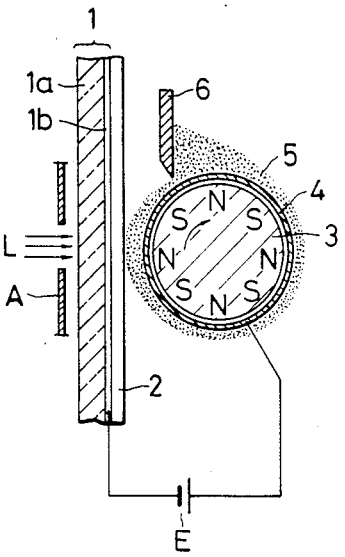
FIG. 1 illustrates the construction of an apparatus to which the present invention is applied.

FIG. 1 shows an example of the construction of an apparatus for carrying out the method of the present invention. The substrate 1 of the photosensitive member may be, for example, a conductive layer 1*b* such as an indium oxide tin film which is a very thin metal film provided on a glass substrate 1*a*. As the photoconductive layer 2 provided on the substrate 1, an N type semiconductor such as, for example, CdS, is applied.

A developing device has a sleeve 4 of non-magnetic metal having a magnet 3 therein, and toner 5 having conductivity and magnetism is held on the surface thereof. The magnet 3 is rotated in the direction of arrow and the toner 5 is conveyed in the direction opposite to the direction of rotation of the magnet 3. A blade 6 is provided in proximity to the outer periphery of the sleeve 4, whereby the toner layer is controlled to a predetermined thickness. A DC voltage is applied to between the conductive layer 1*b* of the photosensitive member 1 and the sleeve 4 of the developing device by a power source E. Since, in the shown example, the photoconductive layer is an N type semiconductor, a positive voltage is applied to the sleeve 4 and a voltage is applied to the toner through the sleeve.

An image light is applied through the substrate 1 of the photosensitive member and toner adheres to the photosensitive member correspondingly to the light portion of the image light, whereby an image is formed.

Figure 2:
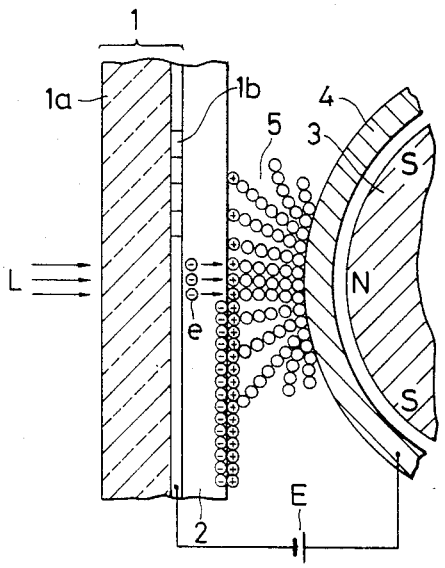
FIGS. 2 and 3 are phenomenon illustrations for illustrating the principle of the present invention.
Figure 3:
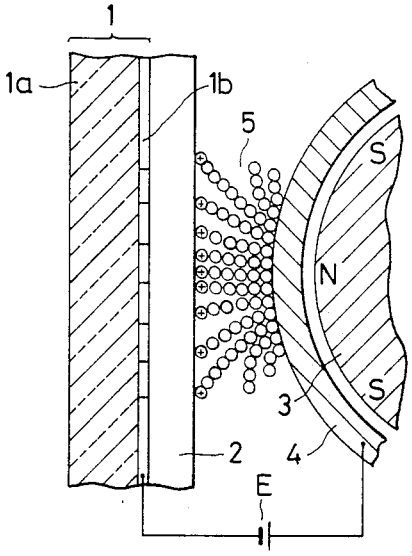

FIGS. 2 and 3 are conceptional views illustrating the principle of the method of the present invention, and FIG. 2 shows the state of charges in the light portion.

When the toner having a voltage applied thereto comes into contact with the photosensitive member, an electric field is applied to the photoconductive layer 2. When the image light is then applied, photocarriers e are produced in the photoconductive layer 2 and these photocarriers are subjected to the action of the electric field and directed to the vicinity of the surface of the photoconductive layer. As a result, strong electrostatic attraction acts between the toner 5 and the photoconductive layer 2 and the toner adheres to the photoconductive layer 2, i.e., the surface of the photosensitive member.

Since, in the shown example, the photoconductive layer 2 is an N type semiconductor and a positive voltage is applied to the toner 5, among pairs of electrons and holes produced near the substrate in the photoconductive layer by the application of the image light L, the electrons are well directed toward the surface of the photoconductive layer. As a result, strong electrostatic attraction acts between the toner 5 and the photosensitive member and the toner adheres to the photosensitive member. FIG. 3 shows the state of charges in the dark portion. By an electric field being applied between the toner 5 and the conductive layer 1*b* of the substrate 1, electrostatic attraction acts therebetween but this attraction is small because the photoconductive layer 2 intervenes therebetween and the distance therebetween is great. Therefore, the toner is separated from the photoconductive layer, i.e., the surface of the photosensitive member, by the magnetic force of the magnet 3 provided in the sleeve and the mutual adhereing forces between the toner particles.

In the manner described above, the toner adheres to the light portion of the photosensitive member while the toner does not adhere to the dark portion of the photosensitive member, and thus there is formed an image on the photosensitive member.

In the image formation method of the present invention, when the photoconductive layer 2 is an N type semiconductor such as CdS, zinc oxide, PVK-TNF or the like, a positive voltage is applied to the toner and, when the photoconductive layer 2 is a P type semiconductor such as Se, SeTe, $As_3Se_2$ or the like, a negative voltage is applied to the toner, but when this polarity has been reversed, sufficient photosensitivity has not been obtained and accordingly, good images have not been obtained.

Considering, for example, a case where, in FIG. 2, a negative voltage is applied to the toner, among pairs of electrons and holes produced near the substrate in the photoconductive layer by application of an image light, the holes must be directed toward the surface of the photoconductive layer. However, in an N type semiconductor, the degree of mobility of holes is remarkably inferior to that of electrons and therefore, such action can hardly be expected.

It is therefore unavoidable to expect the effect that among the pairs of electrons and holes produced near the surface of the photoconductive layer by the light having passed through the photoconductive layer 2 to the vicinity of the surface of such layer, the electrons are directed toward the substrate. However, the photoconductive layer 2 is usually opaque and therefore, the light reaching the vicinity of the surface of the photoconductive layer is very weak and remarkably inferior in sensitivity. Therefore, it would occur to mind to apply the image light from the photoconductive layer side, but when the toner is sufficiently in contact with the surface of the photoconductive layer, the light path is intercepted by the toner and the developing device and thus, it is impossible to provide exposure efficiently. This also holds true in case the photoconductive layer 2 is a P type semiconductor and a positive voltage is applied to the toner.

In contrast, as previously mentioned, in case the photoconductive layer 2 is an N type semiconductor and a positive voltage is applied to the toner and in case the photoconductive layer 2 is a P type semiconductor and a negative voltage is applied to the toner, the pairs of electrons and holes produced near the substrate of the photoconductive layer are effectively directed and therefore the light has high sensitivity. Accordingly, it has been possible to obtain a sufficient image density for a relatively small exposure amount. Also, the ability to obtain a high image density leads to the possibility of reducing the applied voltage to the order of 100 V, for example, and as a result, the adhering force of the toner to the dark portion could be reduced to obtain beautiful images free of fog in the background thereof.

In the image formation method of the present invention, if introduction of charges from the conductive substrate into the photoconductive layer occurs in the dark portion, it may cause said fog but this can easily be eliminated. This is because some energy barrier is created usually in the interface between a conductor and a semiconductor and unless a high voltage above a certain degree is applied, the amount of charges poured is small. Also, in the image formation method of the present invention, images of sufficient density could be formed for the applied voltage of the order of 100 V to 500 V. This is small as compared with the voltage applied to the photosensitive member by a corona discharger or the like in the electrophotographic process such as the known so-called Carlson process or NP process. Accordingly, the deterioration or the like of the photosensitive member has been very much reduced.

Further, in the image formation method of the present invention, the introduction of charges into the photoconductive layer could be substantially completely prevented by providing a thin insulating layer of the order of 0.5 $\mu$–10 $\mu$ formed of a copolymer of vinyl chloride resin and vinyl acetate resin between the conductive layer 1*b* of the substrate 1 and the photoconductive layer 2. In this case, unless the thickness of the insulating layer was made sufficiently thin as compared with the photoconductive layer, sufficient image density could not be obtained in the light portion. This is presumably because one of the pairs of holes and electrons produced by application of light is accumulated on the insulating layer side of the photoconductive layer and therefore the coulomb force for holding the toner is weakened.

In the method of the present invention, if the bias voltage applied between the photosensitive member and the toner was excessively high, the electrostatic attraction between the toner in the dark portion and the photosensitive member was increased and the toner adhered to the dark portion to cause remarkable fog. If, in this condition, a remarkably strong light image was applied, the amount of toner adhering to the light portion was reduced and the amount of toner adhering to the dark portion became greater than the amount of toner adhering to the light portion and this led to the formation of a positive image. This is presumably attributable to the fact that discharge occurs between the surface of the photosensitive member and the toner due to the excessive voltage and exposure and the toner once having adhered to the light portion loses its adhering force. The discharge between the surface of the photosensitive member and the toner is liable to occur when the resistance of the surface of the photosensitive member has been reduced, and such a reduction in the resistance of the surface may occur when the photocarriers greatly produced due to the excessive voltage and the excessive quantity of light have reached the surface of the photosensitive member. Therefore, to obtain a normal negative image, it has been necessary to set the voltage to a low level enough not to cause excessive fog in the image and determine the light so as not to provide excessive exposure. The optimum voltage and exposure amount depend on the type of the photosensitive member, the resistance value of the toner and the time of contact between the toner and the photosensitive member, but it is only when, as compared with the case where a negative image is obtained by the present invention, a high voltage of three to five times or more is applied and an exposure of ten times or stronger is given that a positive image is created and therefore, it is easy to determine the voltage and exposure amount necessary to obtain a normal negative image.

In usual condition, the average life of the photocarriers of a photoconductor is very short and therefore, where exposure is given through a transparent substrate as in the present invention, the photocarriers having reached the surface of the photosensitive member disappear immediately and do not remarkably reduce the resistance of the surface of the photosensitive member. Accordingly, no positive image is created, but to prevent the creation of a positive image more positively, it is preferable to provide a thin layer of insulator on the surface of the photosensitive member.

To obtain a good negative image stably, it is necessary to terminate the application of image light before the toner being supplied to the surface of the photosensitive member is separated therefrom. Since the average life of the photocarrier is very short as previously mentioned, it is considered that the resistance of the surface of the photosensitive member rises immediately even if it is reduced by excessive exposure after the application of image light has been terminated. If, at that time, the developing process is continued, the formed image is developed during that process and a great deal of toner adheres to the light portion and thus, a negative image of sufficient image density is obtained.

Even in a condition in which a normal image is obtained, terminating the application of image light before the toner is separated as previously described is effected to obtain a sharp image of high image density. That is, even in a condition in which the applied voltage is relatively low and a proper exposure amount has been provided, it is considered that some discharge is still taking place between the photosensitive member and the toner and such discharge is reduced by shortening the exposure time. Specifically, this is set by adjustment of the opening width of the slit A of FIG. 1 and the application width of the light image L.

Figure 4A:
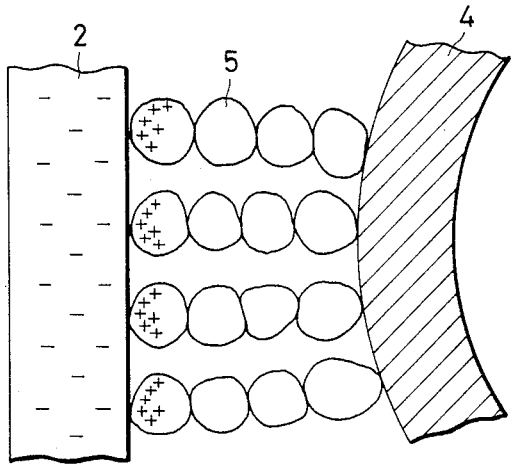
FIGS. 4A and 4B are model views illustrating the developing effect by the relation between the exposure width and the development width.
Figure 4B:
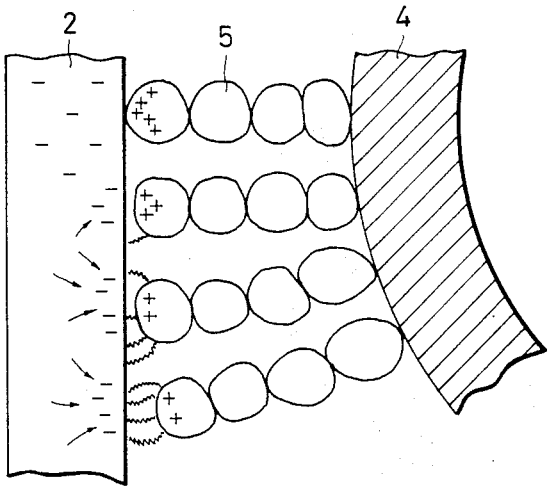

FIGS. 4A and 4B are the analysis of the effect provided by discontinuing the exposure before the toner in contact with the photosensitive member is separated therefrom, and the basis of such effect will now be described by reference to these figures.

FIG. 4A shows a condition in which the photocarriers produced in the photosensitive member due to exposure have gathered on the surface of the photosensitive member due to the potential of the toner and a coulomb force has been created between the photocarriers and the induced charges of the toner. At this time, the toner is intensely attracted by the carrier on the photosensitive member side rather than attracted by the magnetic force of the magnet in the sleeve 4. Accordingly, if the exposure is discontinued in this charge condition, this charge condition is kept as described in connection with FIG. 2 and the sleeve 4 continues to rotate with the toner adhering to the exposed light portion and thus, development of the light portion can be well carried out.

In contrast, if the exposure is continued until the toner is being separated from the photosensitive member, discharge takes place between the photocarriers and the toner when the toner is about to be separated from the photosensitive member simultaneously with the increase of the photocarriers resulting from the increase in exposure amount, and the induced charges of the toner and the photocarriers are lost. Therefore, said coulomb force becomes lower. As a result, the toner cannot sufficiently adhere to the exposed light portion and with the rotation of the sleeve 4, some of the toner is carried away from the photosensitive member by the magnetic force and thus, formation of an image of sufficient density becomes impossible. The arrow in the photosensitive member of FIG. 4B indicates the concentric movement of the photocarriers toward the toner. This phenomenon occurs without being restricted by the polarity.

As described above, if the exposure time is shortened, it becomes difficult to provide a sufficient exposure amount, but in the image formation method of the present invention, a sufficient image density can be obtained for a relatively small exposure amount and therefore, it is easy to provide a sufficient exposure amount while shortening the exposure time.

Where image light is applied while the photosensitive member is moved upwardly or downwardly in FIG. 1, exposure may be provided through a slit 7 having a width narrower than the area in which the toner is in contact with the photosensitive member, as shown. A flash may be used as the exposure light source. In case the photosensitive member has been scanned by laser light modulated by image electrical signals or in case the photosensitive member has been exposed to light by CRT, the exposure width has been very narrow and therefore, if exposure has been provided within the area in which the toner is in contact with the photosensitive member, the application of image light could be terminated before the toner has been separated from the photosensitive member, and thus the aforementioned effect could be obtained.

As the particles having conductivity and magnetism which can be applied to the present invention, use may be made of carbon or the like adhering to around particles of resin containing a magnetic material such as magnetite usable as the toner for electrophotography, or particles such as powdered ferrite or powdered iron, and any of these materials may be chosen depending on usage. These particles may be of a relatively low resistance or may be of a relatively high resistance as disclosed in Japanese Laid-open Patent Application No. 31136/1978 (corresponding U.S. Pat. No. 4,121,931) if they apparently exhibit conductivity by driving a sleeve, a magnet, etc. in the developing process.

In the illustrated example, a voltage has been applied between the sleeve 4 of the developing device and the substrate 1 of the photosensitive member as the method of applying a voltage between the substrate 1 of the photosensitive member and the toner 5, but alternatively, the sleeve 4 may be an insulator and a voltage may be applied to another member such as a blade 6 which is in contact with the toner.

Figure 5:
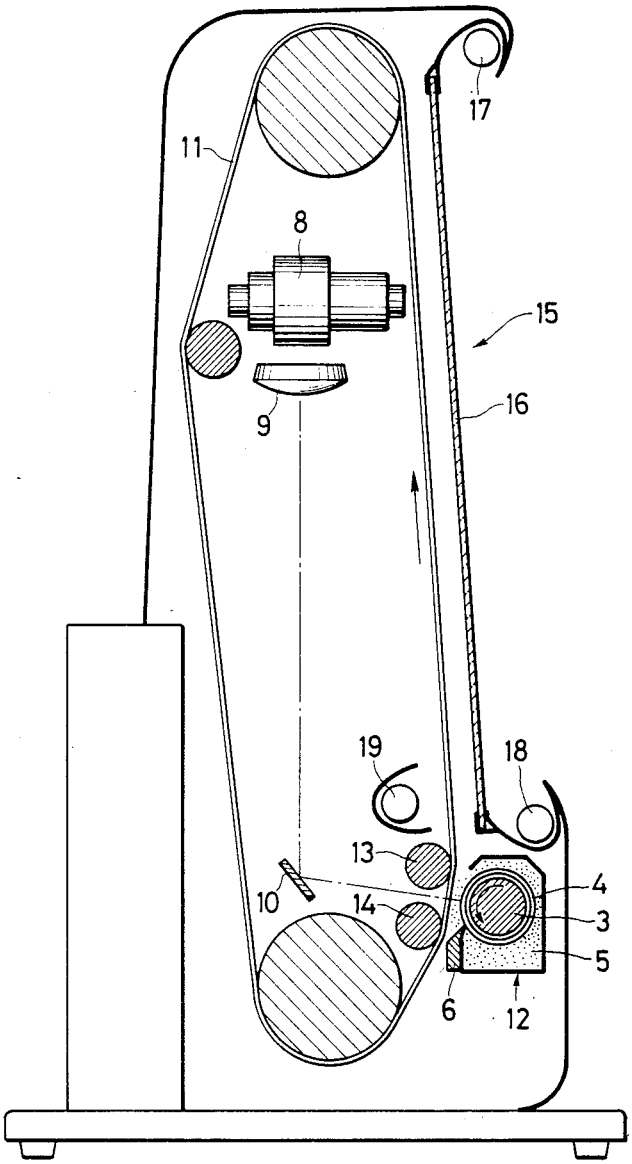
FIG. 5 is a cross-sectional view of an image display apparatus to which the present invention is applied.

FIG. 5 shows an example of the image display apparatus to which the present invention is applied. The output light of a semiconductor laser of 10 mW (not shown) modulated by image electrical signals has been scanned in one direction by a scanner 8 and projected upon the back of a belt-like photosensitive member 11 via f·θ lens 9 and mirror 10. This photosensitive member is rotated in the direction of arrow and comprises a polyethylene terephthalate film surface rendered electrically conductive by providing a thin indium oxide tin film thereon, and CdS with resin as binder applied to a thickness of 65 μ onto said surface. As the CdS, use has been made of the material doped with copper and indium and having a sensitivity peak for the near-infrared light emitted from the semiconductor laser. A developing device 12 has been provided at the exposure position of the photosensitive member through the photosensitive member. A sleeve 4 having a magnet 3 therein has been provided in the developing device and the magnet 3 has been rotated in the direction of arrow.

The toner 5 having conductivity and magnetism supplied to the surface of the sleeve has been controlled to a uniform thickness by the blade 6 and brought into contact with the surface of the photosensitive member. Since the width of the area in which the toner 5 is in contact with the surface of the photosensitive member is very great as compared with the laser beam, development has been continuedly effected even after the exposure by the laser light has been terminated. A DC voltage has been applied between the sleeve of the developing device and the substrate of the photosensitive member by a DC voltage source (not shown). Rollers 13 and 14 are provided near the positions whereat exposure and development are effected, whereby the photosensitive member 11 has been kept smooth and the distance between the surface of the photosensitive member and the sleeve of the developing device has been kept constant with good accuracy. The toner image formed on the surface of the photosensitive member at a position opposed to the developing device is fed to a display portion 15, whereat the movement of the photosensitive member 11 is temporarily stopped. At the display portion, the toner image on the surface of the photosensitive member could be seen through glass 16.

Lamps 17 and 18 illuminate the surface of the photosensitive member to thereby make it easy to see the toner image and also erase the history resulting from the electric field received during the image formation process.

A lamp 19 is for erasing the history of the photosensitive member and is turned on as long as the belt-like photosensitive member is moved, and is turned off as soon as the photosensitive member is stopped.

When the display content is to be changed, the photosensitive member 11 is again moved and the photosensitive member having a toner image on the surface thereof is intactly reused. In this case, the toner image on the surface of the photosensitive member does not adversely affect the next image formation and therefore, there is no necessity of providing special cleaning means and, during the next cycle of image formation, the unnecessary toner image has been erased by the reason set forth in connection with FIG. 3.

Description will now be made of the improvements obtained in case the present invention is used in the image display apparatus of FIG. 5.

Generally, in order that a photoconductor may have photosensitivity, it is indispensable that the photoconductor absorbs the light energy of that wavelength, and a photoconductor having a great absorption for a certain wavelength is also high in absorption factor for the light of a wavelength somewhat shorter than said certain wavelength. Accordingly, a photosensitive member having sensitivity for the near-infrared light (long wavelength light) emitted by a semiconductor laser is usually of a dark color tone and it is difficult to make a photosensitive member of a light color tone. Presently, as the materials of a photosensitive member having sensitivity for the near-infrared light, there are known SeTe, OPC (organic photoconductor) sensitized by a coloring matter, sensitized CdS, etc., but SeTe and sensitized OPC are black and sensitized CdS is of a lighter color tone than others, whereas materials having sufficient sensitivity are of a dark color approximate to brown.

On the other hand, toners for development are usually of a dark color tone. Particularly, toners having magnetism, except those of a color approximate to black, are difficult to prepare. This is due to the fact that the magnetic powder used as the toner material is black or brown.

As described above, if a photosensitive member and toner of a dark color are chosen, the toner image formed on the photosensitive member will be unsightly.

To solve this problem, it is effective to partly improve the layer construction of the photosensitive layer of the photosensitive member. That is, as such improved photosensitive member, use has been made of a photosensitive member comprising a photosensitive layer of high photosensitivity absorbing light and producing photocarriers (hereinafter referred to as the carrier producing layer) layered on a transparent substrate having conductivity, and a photosensitive layer of a lighter color tone than said carrier producing layer and functioning as a moving layer for the carriers (hereinafter referred to as the carrier moving layer) layered on the carrier producing layer. It is common to the aforedescribed photosensitive member in that particles having conductivity and magnetism are brought into contact with the photosensitive member while such particles are held on a toner carrier by a magnetic force and image light is applied from the conductive substrate side of the photosensitive member to the photosensitive layer while a DC voltage is applied between the conductive substrate of the photosensitive member and said particles, whereby an image by the particles is formed on the photosensitive member.

As regards the applied DC voltage, it is desirable to apply a positive voltage to the toner side if both of the carrier producing layer and the carrier moving layer are N type semiconductors, and to apply a negative voltage to the toner side if both of said layers are P type semiconductors, and if said layers are a composite of P type and N type semiconductors, it is desirable to apply a positive voltage to the toner side if the carrier moving layer is an N type semiconductor, and to apply a negative voltage to the toner side if the carrier moving layer is a P type semiconductor.

The image formation method using said photosensitive member will hereinafter be described with reference to the drawings. The common constituent members described in connection with FIGS. 1 to 3 will be explained by the use of the same reference numerals.

Figure 6:
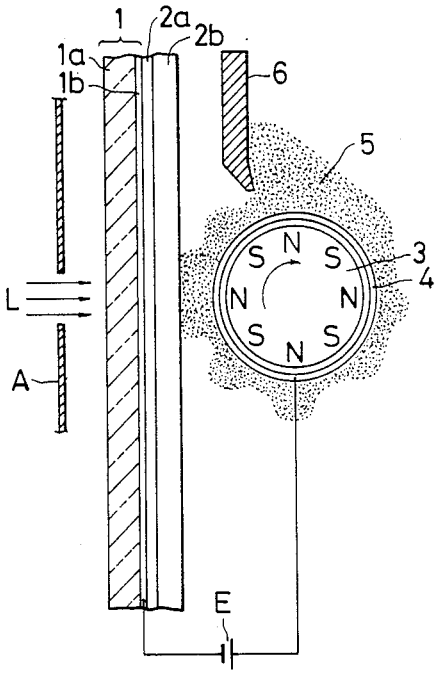
FIG. 6 illustrates the construction of an apparatus to which a modified photosensitive member of the present invention is applied.

FIG. 6 shows an example of the construction of an apparatus for carrying out the image formation method using the photosensitive member having a carrier producing layer and a carrier moving layer. As the substrate 1 of the photosensitive member, use is made of one comprising a glass substrate 1*a* and a thin conductive layer 1*b* of a metal, indium oxide tin or the like provided on the glass substrate 1*a*. A photoconductive layer comprising a carrier producing layer 2*a* of high sensitivity and a carrier moving layer 2*b* of a light color tone is layered on the substrate 1. In the illustrated example, CdS doped with indium and copper has been used as the carrier producing layer 2*a* and CdS doped with a slight amount of copper has been used as the carrier moving layer 2*b*. These have been prepared by being dispersed in resin and solvent used as a binder and applied to the layer thickness of 30 $\mu$ and 35 $\mu$, respectively, and dried.

A DC voltage of 100 V–500 V has been applied from a power source E to between the conductive layer 1*b* of the substrate 1 of the photosensitive member and the sleeve 4 of the developing device. Since, in the illustrated example, both of the carrier producing layer 2*a* and the carrier moving layer 2*b* are CdS, i.e., N type semiconductor, a positive voltage has been applied to the sleeve 4, that is, a negative voltage has been applied to the substrate 1, and a voltage has been applied to the toner 5 through the sleeve 4. The image light has been applied through the substrate 1 of the photosensitive member.

Figure 7:
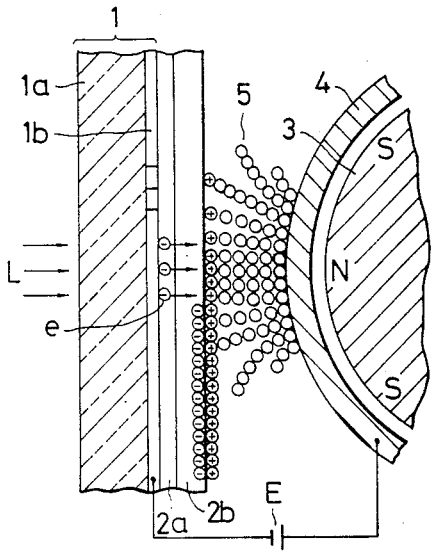
FIGS. 7 and 8 are phenomenon illustrations for illustrating the principle of the image formation of the modified photosensitive member.
Figure 8:
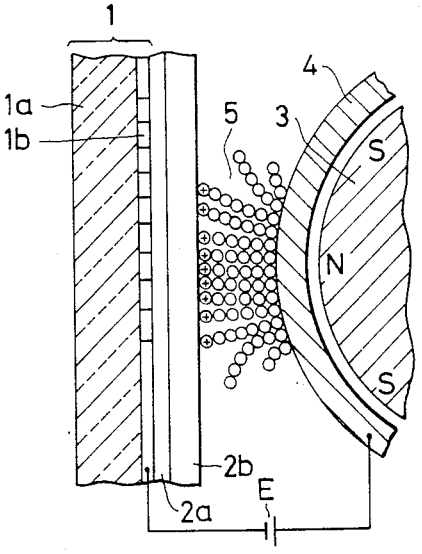

FIGS. 7 and 8 are conceptional views illustrating the principle of the image formation method using the photosensitive member of FIG. 6, and FIG. 7 shows the state of charges in the light portion. When the toner 5 having a voltage applied thereto comes into contact with the surface of the carrier moving layer 2*b*, an electric field is applied to the photoconductive layer comprising the carrier producing layer 2*a* and the carrier moving layer 2*b*. When the image light is then applied, photocarriers e are produced in the carrier producing layer 2*a* and these photocarriers are subjected to the action of the electric field and move through the carrier moving layer 2*b* and are directed to the vicinity of the surface thereof. As a result, strong electrostatic attraction acts between the toner 5 and the carrier moving layer 2*b*, so that the toner adheres to the carrier moving layer, namely, the surface of the photosensitive member.

Since, in the illustrated example, the carrier moving layer 2*b* is an N type semiconductor and a positive voltage is applied to the toner 5, among the pairs of electrons and holes produced in the carrier producing layer 2*a* by the application of the image light L, the electrons e are directed toward the surface of the carrier moving layer and thus, the adhering force of the toner 5 becomes very strong.

FIG. 8 shows the state of charges in the dark portion. By a voltage being applied between the conductive layer 1*b* of the substrate 1 and the toner 5, electrostatic attraction acts therebetween, but this attraction is small because the carrier producing layer 2*a* and the carrier moving layer 2*b* intervene therebetween and therefore the electrostatic capacity is small. Accordingly, the toner is separated from the carrier moving layer 2*b*, namely, the surface of the photosensitive member by the magnetic force of the magnet 3 provided in the sleeve 4 and the mutual adhering forces between the toner particles.

In the manner described above, the toner 5 adheres only to the light portion of the photosensitive member, whereby an image is formed.

Where P type semiconductors are used as the carrier producing layer 2*a* and the carrier moving layer 2*b*, image formation could likewise be accomplished by determining the polarity of the applied voltage reversely to the aforementioned case and applying a negative voltage to the toner 5.

In the image formation method of the present invention, if introduction of charges from the conductive layer 1*b* of the substrate 1 into the photoconductive layer comprising the carrier producing layer 2*a* and the carrier moving layer 2*b* occurs in the dark portion, it may increase the adhering force of the toner in the dark portion and may cause the fogging of the background, but this can be easily eliminated. Similarly to the case of FIG. 1, this is because, usually in the interface between a conductor and a semiconductor, some energy barrier is created and unless a high voltage above a certain level is applied, the amount of introduced charges is small and negligible. Again in this image formation method, images of sufficient density could be formed for an applied voltage of the order of 100 V to 500 V.

Further, again in this image formation method, an insulating layer similar to the one described above could be provided between the conductive layer 1*b* of the substrate 1 and the carrier producing layer 2*a* to thereby completely prevent the introduction of unnecessary charges into the photoconductive layer. It is common to the above-described case that if the thickness of this insulating layer is made sufficiently thin as compared with each photoconductive layer, the image density in the light portion cannot be obtained sufficiently.

In a case where a P type semiconductor and an N type semiconductor have been used as the carrier producing layer 2*a* and the carrier moving layer 2*b*, respectively, and in the reverse case, the introduction of charges e from the substrate 1 into the photoconductive layer could be minimized.

This is because the movement of the introduced charges is blocked by the PN junction formed between the carrier producing layer 2*a* and the carrier moving layer 2*b*. For example, where a P type semiconductor and an N type semiconductor are used as the carrier producing layer 2*a* and the carrier moving layer 2*b*, respectively, if a positive voltage is applied to the toner, an air layer is formed between the carrier producing layer 2*a* and the carrier moving layer 2*b*, whereby the movement of charges from the substrate 1 to the surface of the carrier moving layer, namely, the surface of the photosensitive member, is prevented. In this case, if the carrier producing layer 2*a* is made sufficiently thin, the image light reaches the air layer and therefore, the photocarriers produced in the air layer move to the charge moving layer 2*b*. Accordingly, by blocking the introduction of the charges, a high image density could be secured while preventing the fogging. Also, if the carrier producing layer 2*a* has been an N type semiconductor and the carrier moving layer 2*b* has been a P type semiconductor, image formation could likewise be accomplished by applying a negative voltage to the toner 5.

To form such a PN junction, amorphous silicon or the like doped, for example, with Se, SeTe, $As_3Se_2$ or boron may be used as the P type semiconductor and various OPCs including amorphous silicon PVK-TNF doped, for example, with CdS, CdSe, ZnO or phosphor may be used as the N type semiconductor.

In the photosensitive member in the above-described embodiment, the photoconductive layer is formed by the carrier producing layer and the carrier moving layer and therefore, a semiconductor of a light color can be used as the carrier moving layer, whereby the color of the surface of the photosensitive member can be made into a light color tone and thus, the contrast of the toner image and the surface of the photosensitive member has become high and very easy to see.

On the other hand, any semiconductor of high photosensitivity could be used as the carrier producing layer and a high image density can be obtained for a small exposure amount. The image light is applied through the transparent substrate 1 and therefore, the carrier moving layer does not intercept the image light. Accordingly, it has also become possible to mix a white material such as titanium oxide with the carrier moving layer to thereby provide a lighter color. Also, even if a fog preventing thin insulating layer has been provided on the surface of the photosensitive member, it has not adversely affected the image formation. Therefore, titanium oxide or the like may be applied with resin as a binder, but it is necessary to make the thickness of this insulating layer much thinner than the photosensitive layer and it is difficult to completely cover the insulating layer with a white pigment. Accordingly, it has been effective to make the carrier moving layer of a light-colored material and provide a thin, white insulating layer on the surface thereof. Of course, the color of the insulating layer is not limited to white, but pigments of other colors or fluorescent materials may also be used.

In the above-described photosensitive member whose photosensitive layer has a carrier producing layer and a carrier moving layer, the particles applied to the photosensitive member described in connection with FIG. 1 can be used. Also, the electrical resistance values of these particles may be the same. Of course, as the method of applying a voltage to the particles, the voltage may be applied to a conductive member such as the blade 6 of FIG. 6 which is in direct contact with the particles.

As a specific example of the layer construction of the photosensitive member in a case where the photosensitive member described in connnection with FIG. 6 is applied to the image display apparatus of FIG. 5, one comprising a carrier producing layer and a carrier moving layer provided on the surface of a polyethylene terephthalate film rendered conductive by providing a thin film of indium oxide tin on the surface thereof has been moved in the direction of arrow indicated in FIG. 5.

The carrier producing layer has comprised CdS doped with copper and indium and having sensitivity for the near-infrared light emitted from the semiconductor laser and applied with acrylic resin as a binder. The carrier moving layer does not contain indium but contains a slight amount of copper, and has comprised light yellow CdS applied with acrylic resin as a binder similarly to the carrier producing layer. When image formation has been tried with the distance between the photosensitive member 11 and the sleeve 4 and the applied voltage maintained under the same conditions as in FIG. 5, a sharp recorded image by black toner could be formed on the surface of the light yellow photosensitive member.

That is, even when the photosensitive member of the construction described in connection with FIG. 6 has been used, it has been possible to form a beautiful image of high contrast on the photosensitive member of a light color tone for a relatively small exposure amount by a very simple process, and this has been very effective as an image formation method applied to the image display apparatus or the like.

Description has been made of the case where the N type and the P type semiconductor described in the example of the photosensitive member of FIG. 6 are joined together to form a photosensitive layer. The effect of such joint construction, as mentioned in the foregoing description, resides in the ability to prevent to the utmost the unnecessary carriers from passing to the developed side of the photosensitive member surface. Accordingly, said joint construction is effective not only in a photosensitive member having a photosensitive layer producing carriers and a photosensitive layer conveying the carriers and made into a light color tone.

Description will now be made of the image formation in the case where the P type semiconductor layer and the N type semiconductor layer have been made into a photosensitive layer.

As the P type and N type semiconductor layers, use may be made of, for example, amorphous silicon film containing hydrogen.

The P type semiconductor layer is amorphous silicon containing a III-group element such as boron and the thickness thereof has been of the order of 5000 Å. The N type semiconductor layer is amorphous silicon containing a IV-group element such as phosphor and the thickness thereof has been of the order of 20 $\mu$.

Amorphous silicon, when processed by the usual manufacturing method, becomes N type in a condition in which it is not doped with an impurity, and becomes approximate to a true semiconductor in a condition in which a slight amount of III-group element is added to it. Accordingly, the N type semiconductor layer may be one not doped with an impurity or one doped with a slight amount of III-group element. The surface side layer of the photosensitive member need not be typical P type or N type but may be one approximate to a true semiconductor.

The above-described photosensitive member having the photosensitive layer comprising N type and P type semiconductors joined together obtains on the surface thereof a toner image corresponding to the image light due to the construction of FIG. 6.

Figure 9:
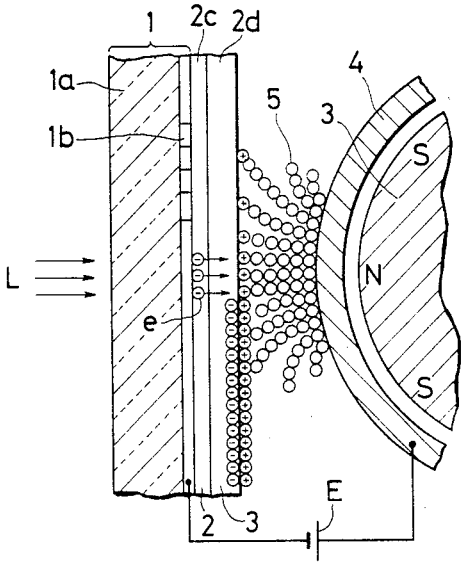
FIGS. 9 and 10 are phenomenon illustrations for illustrating the principle of the image formation of further modified photosensitive members.
Figure 10:
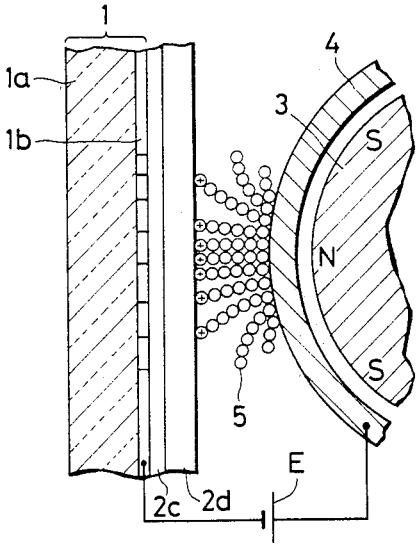

FIGS. 9 and 10 are conceptional views illustrating the principle of the image formation method using said joint photosensitive member, and FIG. 9 shows the state of charges in the light portion. In the following description, parts common to FIGS. 2 and 3 are given identical reference numerals. When the P type semiconductor and the N type semiconductor are layered one upon the other, an air layer resulting from the PN junction is formed in the interface therebetween and rectifiability is created. Since a negative voltage is applied to the P type semiconductor 2*c* side, the thickness of the air layer is increased to block the current. When the image light is then applied, photocarriers e are produced in the air layer and electrons are directed to the N type semiconductor. In the N type semiconductor, the mobility of electrons is great and therefore, the electrons reach the vicinity of the surface of the N type semiconductor 2d and strong electrostatic attraction acts between the toner 5 and the N type semiconductor 2d, so that the toner adheres to the N type semiconductor 2d, namely, the surface of the photosensitive member.

FIG. 10 shows the state of charges in the dark portion. By a voltage being applied between the toner 5 and the conductive layer 1b of the substrate 1, electrostatic attraction acts therebetween, but this attraction is small because the P type semiconductor layer 2c and the N type semiconductor layer 2d intervene therebetween and the distance therebetween is great. The photosensitive layer is of PN junction as previously noted and a voltage is applied in a direction to block the current, and therefore charges are scarcely introduced from the substrate into the surface of the photosensitive member. Accordingly, the adherence of the toner to the dark portion can be minimized.

In the present embodiment, it is desirable that the P type semiconductor layer provided on the substrate side be made thin as compared with the N type semiconductor layer provided on the surface side. If the layer on the substrate side is made thin, the PN junction is formed at a position near the substrate and, if a voltage is applied thereto, the air layer almost extends to the surface of the substrate. If image light is then applied, the image light is absorbed into the air layer and the produced photocarriers act effectively. In contrast, if the P type semiconductor layer is made thicker than the N type semiconductor layer, the PN junction will be formed on the surface side of the photosensitive member. Therefore, the image light will be absorbed into the P type semiconductor layer. In this P type semiconductor, the mobility of electrons is inferior and so, the produced photocarriers do not act effectively. Accordingly, high photosensitivity cannot be obtained. If both the P type semiconductor layer and the N type semiconductor layer are made thin, the potential of the conductive layer 1b will reach the surface of the photosensitive member and the adhering force of the toner in the dark portion of the image light will increase, and thus fog is liable to occur. When this is taken into account, it is desirable that within a range in which the image light is not absorbed, the layer on the substrate side of the photosensitive member be made relatively thin and the layer on the surface side of the photosensitive member be made thick.

Although, in the illustrated example, the P type semiconductor is provided on the substrate side, it will be apparent that even if the N type semiconductor is provided on the substrate side and a positive voltage is applied to the substrate side, image formation can likewise to accomplished. In the image formation method using the above-described joint type photosensitive member, the optimum value of the voltage to be applied between the photosensitive member and the sleeve differs depending on the resistivity, dielectric constant and thickness of the photoconductive layer and the resistivity and particle diameter of the toner, and generally a voltage of 100 V to 500 V has been optimum. Accordingly, the photosensitive member is rarely deteriorated by a strong electric field. If the applied voltage has been excessively low, the image density has been deficient. Conversely, when the applied voltage has been excessively high, the electrostatic attraction between the toner and the photosensitive member in the dark portion has increased and the toner has adhered to the dark portion to cause remarkable fog. Also, when a remarkably intense image light has been applied in this condition, the amount of toner adhering to the light portion has decreased while the amount of toner adhering to the dark portion has increased, thereby causing a positive image to be formed. These causes are in accord with those in the case of the photosensitive member of FIG. 1.

Again in the above-described embodiment, the setting of the optimum voltage and exposure amount differs depending on the type of the photosensitive member, the resistance value of the toner and the time of contact between the toner and the photosensitive member, but the case where a positive image is created is only the case where a high voltage of three to five times or more is applied and a strong exposure of ten times or more is provided as compared with a case where a negative image is obtained and therefore, it is easy to determine the voltage and exposure amount necessary to obtain a normal negative image.

Further, as in the photosensitive member of another embodiment, there has been no creation of a positive image which is caused by the fog resulting from remarkably reducing the resistance of the surface of the photosensitive member due to the photocarriers produced by the light resulting from exposure. This is because the average life of the photocarriers in the photoconductor is very short. However, to positively prevent the creation of this positive image, it is preferable that a thin layer of insulator be provided on the surface of the photosensitive member. Also, to obtain a good negative image stably, it has been necessary to terminate the application of the image light before the toner supplied to the surface of the photosensitive member is separated therefrom. This also holds true of the photosensitive member of FIG. 6, and the reason therefor is as set forth in connection with FIG. 4.

While, in the foregoing example, amorphous silicon is used as the material of the photoconductive layer, other various known materials may be used. For example, Se, SeTe, $As_3Se_2$, etc. are known as the P type semiconductor, and CdS, CdSe, ZnO, PVK-TNF, etc. are known as the N type semiconductor, and a suitable combination of these materials may be used. In case the semiconductor used on the substrate side differs from the semiconductor used on the surface side, if a material of high photosensitivity is used on the substrate side, an image can be formed for a small exposure amount. Generally, materials of high photosensitivity are low in dark resistance and many of them are difficult to use as a photosensitive member for electrophotography, but in the above-described method, the layer on the substrate side can be made very thin and the amount of thermally produced free carriers can be reduced. Therefore, use may be made of even a material such as polycrystal silicon which is high in photosensitivity and low in dark resistance.

As has been fully described above, according to the image formation method of the present invention, beautiful images could be formed for a relatively small exposure amount by a simple process in which the photosensitive member is not charged.

What we claim is:

1. A method for forming a toner image on a photosensitive member, the image corresponding to light information applied to the photosensitive member, said method comprising the steps of:

providing a two-sided photosensitive member having a photoconductive layer and a conductive layer;

applying light information to said photosensitive member from the side;

supplying conductive toner to the photoconductive layer side of the photosensitive member and opposite to the side to which the light information is applied;

simulaneously applying a bias voltage between the conductive layer of the photosensitive member and the supplied toner so that at the region where the light information has been applied, carriers having a polarity opposite to the polarity of the toner are moved within the photoconductive layer toward the toner so as to adhere toner on the surface of the photosensitive member to form a toner image corresponding to said light information; and terminating the application of light information before separating the toner supply from the photosensitive member.

2. The method according to claim 1, wherein when the photoconductive layer of the photosensitive member is an N type semiconductor, a negative (−) voltage is applied to the conductive layer of the photosensitive member and a positive (+) voltage is applied to the toner.

3. The method according to claim 1, wherein when the photoconductor layer of the photosensitive member is a P type semiconductor, a positive (+) voltage is applied to the conductive layer of the photosensitve member and a negative (−) voltage is applied to the toner.

4. The method according to claim 1, wherein said photoconductive layer includes a carrier generating layer and carrier moving layer in that order from the side to which the light information is applied.

5. The method according to claim 4, wherein said photosensitive member has an insulating layer between the conductive layer and the photoconductive layer.

6. The method according to claim 1, wherein said photosensitive member has an insulating layer between the conductive layer and the photoconductive layer.

7. The method according to claim 1, wherein the photoconductive layer of the photosensitive member is a combination of an N type semiconductor and a P type semiconductor.

8. The method according to claim 1, wherein the surface of the photosensitive member to which the toner is supplied is an insulating layer.

9. The method according to claim 1, wherein the color of the side of the photosensitive member to which the toner is applied is a light color relative to the color of the toner.

10. Apparatus for forming a toner image on a photosensitive member, the image corresponding to light information applied to the photosensitive member, said apparatus comprising:

a two-sided photosensitive member having a photoconductive layer and a conductive layer;

means for applying light information from the conductive layer side of said photosensitive member;

means for supplying conductive toner to the photoconductive layer side of said photosensitive member and opposite to the side to which the light information is applied;

means for applying a bias voltage between the conductive layer and the toner, said photoconductive layer having the property that at the region where the light information is applied, carriers having a polarity opposite to the polarity of the applied toner move toward the applied toner; and means for terminating the application of light information before separating the toner supply, by said supplying means, from the photosensitive member.

11. An apparatus according to claim 10, wherein a lamp for erasing hysteresis of the photosensitive member is provided near said photosensitive member.

12. An apparatus according to claim 10, wherein said photosensitive member includes an endless loop and said supplying means is disposed proximate to a lower portion of said loop and further comprising optical means disposed within said loop.

13. Apparatus for forming a toner image on a photosensitive member, the image corresponding to light information applied to the photosensitive member, said apparatus comprising:

a movably supported two-sided photosensitive member having an inner conductive layer and an outer photoconductive layer;

means for exposing a light image at the conductive layer side of said photosensitive member;

means for supplying conductive toner to the photosensitive member at the outer peripheral surface side thereof and opposite to the exposing position of said exposing means;

means for applying a bias voltage between the conductive layer of said photosensitive member and the toner, said photoconductive layer of the photosensitive member having the property that at the region where light is applied, carriers having a polarity opposite to the polarity of the applied toner move toward the applied toner to form a toner image corresponding to the light information;

means for terminating the exposure of a light image before separating the toner supply, by said supplying means, from the photosensitive member; and a housing having an optical aperture for observing the toner image formed on said photosensitive member.

14. The apparatus according to claim 10 or 13, wherein said termination of application of light information is controlled by a slit opening for light information.

15. The apparatus according to claim 10 or 13, wherein the photoconductive layer of said photosensitve member has a layer for producing photocarriers by the application of light thereto, and a layer for moving the produced photocarriers to the side to which the toner is supplied.

16. The apparatus according to claim 10 or 13, wherein the photoconductive layer of said photosensitive member has a layered structure of a P type semiconductor and an N type semiconductor layer.

17. Apparatus according to claim 10 or 13, wherein the photoconductive layer of the photosensitive member is P type semiconductor and positive charge is applied to the conductive layer of the photosensitive member and negative charge is applied to the toner.

18. Apparatus according to claim 10 or 13, wherein said photosensitive member has an insulating layer between the conductive layer and the photoconductive layer.

19. Apparatus according to claim 10 or 13, wherein said photosensitive member has an insulating layer at the surface to which the toner is supplied.

20. Apparatus according to claim 10 or 13, wherein the surface of said photosensitive member to which the toner is supplied is of a light color relative to the color of the toner.

* * * * *

UNITED STATES PATENT AND TRADEMARK OFFICE

CERTIFICATE OF CORRECTION

PATENT NO. : 4,649,094

DATED : March 10, 1987

INVENTOR(S) : YASUYUKI TAMURA, ET AL.

It is certified that error appears in the above-identified patent and that said Letters Patent is hereby corrected as shown below:

COLUMN 2

Line 7, "a" should read --the same--.

COLUMN 5

Line 31, "adhereing" should read --adhering--.

COLUMN 6

Line 12, "substrate" should read --surface--.

COLUMN 14

Line 36, "phosphor" should read --phosphorus--.

COLUMN 15

Line 55, "accomplished. In" should read --accomplished. ¶In--.

COLUMN 17

Line 4, "the side;" should read --the conductive layer side;--.

Line 9, "simulaneously" should read --simultaneously--.

Line 29, "photosensitve" should read --photosensitive--.

UNITED STATES PATENT AND TRADEMARK OFFICE

CERTIFICATE OF CORRECTION

PATENT NO. : 4,649,094

DATED : March 10, 1987

INVENTOR(S) : Yasuyuki Tamura, et al

It is certified that error appears in the above-identified patent and that said Letters Patent is hereby corrected as shown below:

Column 18, line 45, "sitve" should read -- sitive --.

Signed and Sealed this

Sixteenth Day of February, 1988

*Attest:*

*Attesting Officer*

DONALD J. QUIGG

*Commissioner of Patents and Trademarks*